US006693497B2

(12) United States Patent
Scott et al.

(10) Patent No.: US 6,693,497 B2
(45) Date of Patent: Feb. 17, 2004

(54) DEVICE FOR CONVERTING CIRCULARLY OSCILLATING ELECTROMAGNETIC RADIATION BEAMS INTO LINEARLY OSCILLATING RADIATION BEAMS

(76) Inventors: Brian Scott, 220 Northgate Great Yarmouth, Norfolk (GB); Bernd Rümmeli, Koppelberg 8, 24159 Kiel-Friedrichsort (DE)

( * ) Notice: Subject to any disclaimer, the term of this patent is extended or adjusted under 35 U.S.C. 154(b) by 170 days.

(21) Appl. No.: 09/835,877

(22) Filed: Apr. 16, 2001

(65) Prior Publication Data

US 2002/0154402 A1 Oct. 24, 2002

(30) Foreign Application Priority Data

Apr. 14, 2000 (DE) ..... 200 06 916 U

(51) Int. Cl.[7] ..... H01D 1/17

(52) U.S. Cl. ..... 333/21 A; 343/756; 333/135; 333/248

(58) Field of Search ..... 333/21 A, 248, 333/251, 21 R, 125, 135, 137; 343/756; 359/483

(56) References Cited

U.S. PATENT DOCUMENTS 5,440,279 A * 8/1995 Kinoshita et al. ..... 333/26
6,100,703 A * 8/2000 Davidov et al. ..... 324/631

* cited by examiner

*Primary Examiner*—Robert Pascal
*Assistant Examiner*—Kimberly E Glenn
(74) *Attorney, Agent, or Firm*—Henry M. Feiereisen

(57) ABSTRACT

A device is disclosed for converting a circularly polarized electromagnetic radiation into linearly polarized electromagnetic radiation. The device includes a depolarizer with depolarizing elements supported in a polarization mode converter for rotation between a vertical output and a horizontal output. A depolarization position for circularly polarized radiation exists between the horizontal output and the vertical output. The rotation direction of the depolarizer can be adjusted to selectively direct left-handed circularly polarized and right-handed circularly polarized radiation either to the vertical or the horizontal output.

9 Claims, 1 Drawing Sheet

8
6
9
1
3
19
4
7
23
10

6
1
3
19
5
10

1
21
20
19
1
22

10
1
19
5
6
16
17
3
18

28
2
24
VII
29
27
25
VII 24
2
26
25
30

2
25
24
26

6
1
11
12
IX
3
18
19
5
13
10
15
14
IX 3
1
2
4
25
26
24

3
1
2
26
4
24
25

1
2
3
4
25
26
24

1
2
3
4
26
24

DEVICE FOR CONVERTING CIRCULARLY OSCILLATING ELECTROMAGNETIC RADIATION BEAMS INTO LINEARLY OSCILLATING RADIATION BEAMS

BACKGROUND OF THE INVENTION

The invention relates to a device for converting circularly oscillating electromagnetic radiation beams into linearly oscillating radiation beams.

Some transmitters used in satellite transmission technology emit linearly polarized radiation beams, whereas others emit circularly polarized radiation beams. The radiation beam of a transmitter emitting linearly oscillating radiation beams can be converted from a horizontally extending oscillation beam into a vertically extending oscillation beam, and vice versa from a vertically extending radiation beam into a horizontally extending radiation beams using an oscillation mode converter (OMT), so that the received radiation beam can be oriented to match the antenna characteristic.

Difficulties arise with radiation beams having a circular oscillation, which can only be received by antennas capable of receiving circularly oscillating radiation beams. A conversion of a circularly oscillating radiation beam into a radiation beams that can be received by an antenna adapted for linearly oscillating radiation beams has not been possible hereto.

SUMMARY OF THE INVENTION

It is therefore an object of the present invention to provide an apparatus which can allows circularly oscillating radiation beams to be received by antennas that are adapted to receive linearly oscillating radiation beams.

This object is solved by the invention in that a depolarizer is supported in an oscillation converter for rotation between a vertical output for vertically oscillating radiation beams and a horizontal output for horizontally oscillating radiation beams, and that between the horizontal output and the vertical output a depolarization position for circularly oscillating radiation beams is provided, in which depending on the rotation direction of the depolarizer radiation, a beam performing a left-handed oscillation can be supplied either to the horizontal output or the vertical output and a radiation beam performing a right-handed oscillation can be supplied either to the vertical output or the horizontal output.

In this way, linearly oscillating radiation beams can appear at the respective outputs of the oscillation converter, regardless if a linearly or circularly oscillating radiation beam is supplied to the oscillation converter. The device can output either horizontally or vertically oscillating radiation beams depending on the antenna design. Accordingly, antennas adapted for receiving linearly oscillating radiation beams can always be used for receiving the radiation beams, independent of the respective radiation beam source.

According to a preferred embodiment of the invention, the depolarization position for circularly oscillating radiation beams is at an angle of 45° relative to both the horizontal and the vertical direction. By selecting a 45° angle, the received energy of the circularly oscillating radiation beams can be optimized.

According to another preferred embodiment of the invention, a motor drive is provided for rotating the depolarizer. Advantageously, the drives are implemented as electric drives which can be easily controlled.

According to another preferred embodiment of the invention, the motor drive includes a controller that relies on the oscillation direction of the incident radiation beams. With this controller, the depolarizer can be automatically rotated independent of the oscillation direction of the incident radiation beams. By rotating the depolarizer, the orientation of the depolarizer inside the oscillation converter can be adjusted so that the radiation beams exiting the oscillation converter have the desired oscillation direction.

According to another preferred embodiment of the invention, the depolarizer has depolarizing elements which are oriented vertically to match a vertical oscillation of the incident radiation beams. With this design, vertically oscillating radiation beams exits the oscillation converter without conversion. A horizontally oscillating radiation beam can be treated in an analogous manner.

According to another preferred embodiment of the invention, for a circular oscillation of the incident radiation beams, the depolarizing elements are oriented at an angle of 45° with respect to both the horizontal and the vertical direction. With this orientation of the depolarizer, either the horizontal or the vertical component of the incident radiation beams exits the oscillation converter.

According to another preferred embodiment of the invention, the depolarizing elements of the depolarizer can be rotated from the vertical direction towards the horizontal direction by 45° for obtaining horizontally oscillating radiation beams from circularly oscillating radiation beams. By rotating the depolarizing elements from the vertical direction into the horizontal direction in this manner, the oscillation converter is able to convert centrally oscillating radiation beams into horizontally oscillating radiation beams.

According to another preferred embodiment of the invention, the depolarizing elements of the depolarizer can be rotated from the horizontal direction towards the vertical direction by 45° for obtaining vertically oscillating radiation beams. In this position, the circularly oscillating radiation beams exit the converter predominantly as radiation beams oscillating in the vertical direction.

BRIEF DESCRIPTION OF THE DRAWINGS

Further details of the invention will described in the following detailed description and the appended drawings, which illustrate an exemplary preferred embodiment of the invention.

It is shown in the drawings.

DETAILED DESCRIPTION OF PREFERRED EMBODIMENTS

Figure 1:
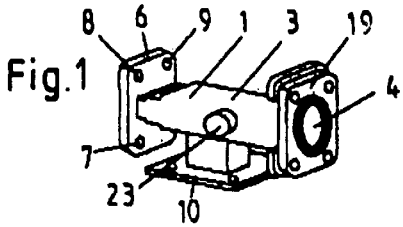
FIG. 1 a perspective view of an oscillation converter.

A device for converting circularly oscillating electromagnetic radiation beams consists essentially of an oscillation converter 1 and a depolarizer 2. The oscillation converter 2 has a cylindrical section 3 that surrounds a cylindrical interior space 4. Both ends 5 of the interior space 4 include a flange 6 with threaded through bores 7, 8, 9. The oscillation converter 1 is attached with flange 6 to a radiation beam source (not shown), allowing the radiation beams exiting from the radiation beams source to enter the interior space 4.

The oscillation converter 1 includes an additional flange 10 which is also provided with threaded bores 11, 12, 13, 14. An opening 15 extends through the additional flange 10 and is connected with an access 16 to the interior space 4. The center axis 17 extending through the access 16 is oriented perpendicular to a center axis 18 that extends through the interior space 4.

Figure 4:
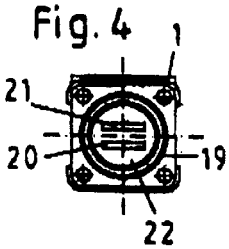
Figure 3:
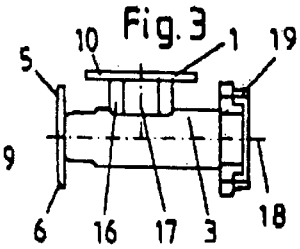
FIG. 3 a side view of an oscillation converter, rotated by 90° with respect to FIG. 2, FIG. 4 a front view of an oscillation converter, FIG. 5 a side view of the oscillation converter, rotated by 90° with respect to FIG. 3, FIG. 6 a side view of a cylindrical depolarizer, FIG. 7 a cross-section through a depolarizer taken along of the line VII—VII in FIG. 6, FIG. 8 a cross-section through an oscillation converter, rotated by 45° with respect to FIG. 7, FIG. 9 a cross-section through an oscillation converter with an installed depolarizer taken along the line IX—IX in FIG. 5, FIG. 10 a cross-section through an oscillation converter with a depolarizer that is rotated by 90° with respect to FIG. 9, FIG. 11 a cross-section through an oscillation converter with a depolarizer that is rotated towards the right by 45° with respect to FIG. 9, and FIG. 12 a cross-section through an oscillation converter with a depolarizer that is rotated towards the left by 45° with respect to FIG. 9.
Figure 6:
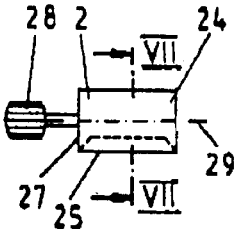
Figure 7:
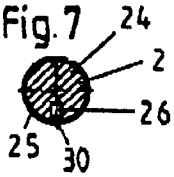

The side of the cylindrical section 3 facing away from the flange 6 is bound by an exit port 19. The exit port 19 has slits 20, 21 which extend through a center section 22 of the exit port 19. The center section 22 is rotatably supported for rotation about the center axis 18 of the interior space 4. The slits 20, 21 can thereby be oriented relative to the interior space 4 so as to extend in a horizontal direction (FIG. 4) or perpendicular thereto in a vertical direction. The slits 20, 21 are parallel to one another.

A switch 23 is rotatably supported on the cylindrical section 3 in a region where the additional flange 10 terminates in the cylindrical section 3. Rotation of this switch 23 also rotates deflection planes (not shown) disposed inside the interior space 4. For radiation beams that enters the cylindrical section 3 in the direction of the center axis 17, the deflection plane (not shown) can be adjusted so that the radiation beam entering through the opening 15 in the direction of the center axis 17 are deflected towards the center axis 18 and exit from the interior space 4 in the region of the exit port 19. Depending on the position of the slits 20, 21, the radiation beam that is deflected inside the interior space 4 exits either as a horizontally oscillating radiation beam or as a vertically oscillating radiation beam.

Likewise, the slits 20, 21 can also influence the oscillation plane of the radiation beams that enter the interior space 4 through the end 5 along the center axis 18 and exit through the output port 19. Depending on their position, the slits 20, 21 can convert the radiation beams traveling in the longitudinal direction of the cylindrical section 3, or alternatively can pass the radiation beams in their original oscillation direction.

The depolarizer 2 consists essentially of a cylinder 24 with a cylinder surface 25 on which depolarizing elements 26 are placed. These depolarizing elements 26 are able to depolarize polarized radiation beams, with the depolarized radiation beams having a large number of oscillation directions.

The depolarizer 2 is fitted into the interior space 4 so as to be rotatable about the center axis 18. The depolarizer 2 can be rotated manually. Alternatively or in addition, at least one end 17 of the depolarizer can have a drive motor 28 which rotates the depolarizer 2 about its longitudinal axis 29. The rotation can orient the depolarizing elements 26 in an arbitrary position relative to the interior space 4.

Figure 2:
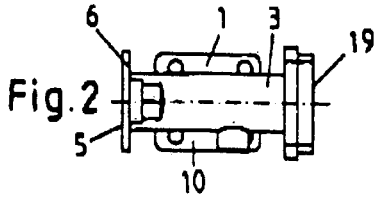
FIG. 2 a side view of an oscillation converter.
Figure 9:
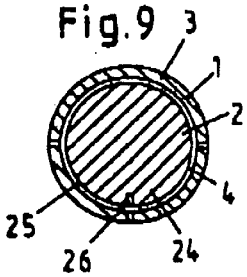
Figure 10:
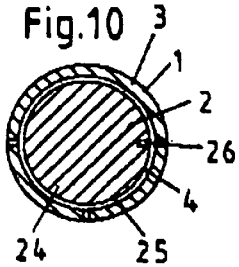

For example, if the depolarizing element 26 is oriented with its longitudinal axis 30 parallel to the direction of the slits 20, 21, then approximately the entire beam that has been depolarized by the depolarizing element 26 passes through the slits 20, 21 in the horizontal direction. This orientation of the depolarizer 26 is illustrated in FIG. 10. Conversely, if radiation beams oscillating in the vertical direction are desired, then the slits 20, 21 are rotated by 90° with respect to their respective orientation depicted in FIG. 2. The depolarizing element 26 of the depolarizer 2 is rotated accordingly to match the direction of the vertically oriented slits 21, 22. This orientation is indicated in FIG. 9. In this case, radiation beams oscillating in the vertical direction exit from the interior space 4.

Figure 8:
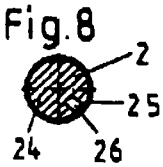
Figure 5:
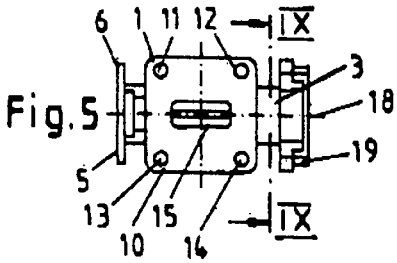
Figure 11:
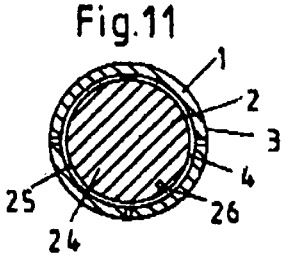
Figure 12:
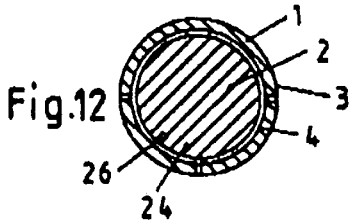

However, if circularly oscillating radiation beams enter the interior space 4 with the installed depolarizer 2 through the end 5 of the oscillation converter 1, then the depolarizer 2 is rotated about the center axis 18 so that the depolarizing elements 26 are oriented at an angle of 45° with respect to the horizontal and vertical directions, respectively. This rotation direction of the depolarizer is depicted in FIGS. 8, 11 and 12. In this rotation direction, the circularly polarized radiation beams are converted into either horizontally or vertically oscillating radiation beams.

The conversion of circularly oscillating radiation beams into linearly oscillating radiation beams is dependent of the rotation direction in which the depolarizer 2 is rotated in the interior space 4. The conversion of the circularly oscillating radiation beams into linearly oscillating radiation beams depends on the direction in which the depolarizer 2 is rotated. For example, if for incident circularly oscillating radiation beams, the depolarizer is rotated from its initial position, where it is transparent for horizontally oscillating radiation beams, into the position indicated in FIG. 8, wherein the depolarizing element 26 is rotated from its horizontal position direction by 45° towards the vertical position, then the incident circularly oscillating radiation beams are converted into linearly vertically oscillating radiation beams. If the depolarizer 2 is rotated from this position by another 45° towards the horizontal position, then circularly oscillating radiation beams are converted into linearly horizontally oscillating radiation beams.

When an electric drive motor 28 is employed for rotating the depolarizer 2, then a controller can be used for the drive motor 28 which is dependent on the radiation beams to be oriented. Accordingly, if the incident radiation beams are determined to be circularly oscillating, then the controller (not shown) of the drive motor 28 provides a pulse which rotates the depolarizing element into a 45° position halfway between the horizontal and vertical position. If it is determined after the rotation, that the radiation beams exiting the output port 19 do not match the receiving antenna, then the controller (not shown) controls the drive motor 28 again automatically so that for continued incident circularly oscillating radiation beam the depolarizer 2 is rotated once more by 90°. In this position, the circularly oscillating radiation beam received by the oscillation converter 1 is converted into a vertically oscillating radiation beam.

What is claimed is:

1. A device for converting circularly polarized electromagnetic radiation into linearly polarized electromagnetic radiation, comprising:

a polarization mode converter having at least one slit with a slit orientation rotatable between a first output direction and a second output direction; and a depolarizer having depolarizing elements defining a depolarization position and rotatably supported in the polarization mode converter for rotation between the first output direction and the second output direction;

wherein for the incident circularly polarized radiation, the depolarization position is intermediate between the first output direction and the second output direction, in which depolarization position incident left-handed circularly polarized radiation is supplied to one of the first output direction and the second output direction, and incident right-handed circularly polarized radiation is supplied to the other of the second output direction and the first output direction.

2. The device of claim 1, wherein the depolarization position for circularly polarized radiation is at an angle of 45° intermediate between the first and the second output directions.

3. The device of claim 1, further including a manual drive for rotating the depolarizer in the polarization mode converter.

4. The device of claim 1, further including a motor drive for rotating the depolarizer in the polarization mode converter.

5. The device of claim 4, wherein the motor drive includes a controller that adjusts the motor drive depending on the polarization direction of the incident radiation.

6. The device of claim 1, wherein the depolarizing elements are oriented vertically for vertically polarized incident radiation.

7. The device of claim 1, wherein the depolarizing elements are oriented horizontally for horizontally polarized incident radiation.

8. The device of claim 1, wherein for converting circularly polarized radiation into horizontally polarized radiation, the at least one slit of the polarization mode converter is aligned horizontally and the depolarizing elements of the depolarizer are rotated clockwise from the vertical direction towards the horizontal direction by 45°.

9. The device of claim 1, wherein for converting circularly polarized radiation into vertically polarized radiation, the at least one slit of the polarization mode converter is aligned vertically and the depolarizing elements of the depolarizer are rotated clockwise from the horizontal direction towards the vertical direction by 45°.

* * * * *